US012092403B2

(12) United States Patent
Morimoto et al.

(10) Patent No.: US 12,092,403 B2
(45) Date of Patent: Sep. 17, 2024

(54) HEAT EXCHANGER

(71) Applicant: DENSO CORPORATION, Kariya (JP)

(72) Inventors: Keita Morimoto, Kariya (JP); Eiichi Torigoe, Kariya (JP)

(73) Assignee: DENSO CORPORATION, Kariya (JP)

( * ) Notice: Subject to any disclaimer, the term of this patent is extended or adjusted under 35 U.S.C. 154(b) by 296 days.

(21) Appl. No.: 17/592,680

(22) Filed: Feb. 4, 2022

(65) Prior Publication Data

US 2022/0155028 A1 May 19, 2022

Related U.S. Application Data

(63) Continuation of application No. PCT/JP2020/029541, filed on Jul. 31, 2020.

(30) Foreign Application Priority Data

Aug. 6, 2019 (JP) ..... 2019-144656

(51) Int. Cl.

| | |
|---|---|
| ***F28F 17/00*** | (2006.01) |
| ***F28F 1/30*** | (2006.01) |
| ***F28F 13/18*** | (2006.01) |
| *F28D 21/00* | (2006.01) |

(52) U.S. Cl.

CPC ..... *F28F 17/005* (2013.01); *F28F 1/30* (2013.01); *F28F 13/18* (2013.01); *F28D 2021/0085* (2013.01); *F28F 2245/02* (2013.01)

(58) Field of Classification Search

CPC ..... F28D 15/046; F28D 2021/0085; F28F 2245/02; F28F 17/005; F28F 13/18

See application file for complete search history.

(56) References Cited

U.S. PATENT DOCUMENTS

| | | | | |
|---|---|---|---|---|
| 5,201,367 A * | 4/1993 | Dubrovsky | ..... | B21D 13/04 165/182 |
| 6,889,759 B2 * | 5/2005 | Derosier | ..... | F28F 1/32 165/181 |
| 7,475,719 B2 * | 1/2009 | Derosier | ..... | F28F 17/005 165/182 |

(Continued)

FOREIGN PATENT DOCUMENTS

| | | |
|---|---|---|
| JP | S59-109418 A | 6/1984 |
| JP | 2010025477 A | 2/2010 |

(Continued)

*Primary Examiner* — Devon Russell

(74) *Attorney, Agent, or Firm* — Harness, Dickey & Pierce, P.L.C.

(57) ABSTRACT

A heat exchanger includes tubes through which a first fluid flows, and a corrugated fin configured to improve a heat exchange efficiency between the first fluid flowing through the tubes and a second fluid flowing outside of the tubes. The corrugated fin includes bending portions connected to adjacent two tubes of the tubes and fin body portions extending between the bending portions. Each of the fin body portions includes grooves on a surface thereof and a protrusion. Each of the grooves extends in an extending direction from one of the adjacent two tubes toward the other. The protrusion is disposed at an intermediate position of at least one of the grooves between the adjacent two tubes in the extending direction. The protrusion protrudes from a bottom of the at least one of the grooves toward the surface.

10 Claims, 11 Drawing Sheets

(56) References Cited

U.S. PATENT DOCUMENTS

| | | | | |
|---|---|---|---|---|
| 2007/0251681 | A1* | 11/2007 | Higashiyama | F28D 1/05391 165/153 |
| 2012/0318485 | A1* | 12/2012 | Yabe | F28F 3/025 165/185 |
| 2016/0348987 | A1* | 12/2016 | Minami | B21D 53/04 |
| 2020/0096226 | A1 | 3/2020 | Morimoto et al. | |
| 2020/0096264 | A1 | 3/2020 | Morimoto et al. | |

FOREIGN PATENT DOCUMENTS

| | | | | | |
|---|---|---|---|---|---|
| JP | 2013245883 | A | | 12/2013 | |
| JP | 6225042 | B2 | | 11/2017 | |
| JP | 2019002588 | A | * | 1/2019 | F24F 13/22 |
| JP | 2019002589 | A | * | 1/2019 | F28D 1/05383 |
| JP | 2019-163921 | A | | 9/2019 | |
| WO | WO-2018230431 | A1 | * | 12/2018 | F28D 1/05383 |

* cited by examiner

HEAT EXCHANGER

CROSS REFERENCE TO RELATED APPLICATION

The present application is a continuation application of International Patent Application No. PCT/JP2020/029541 filed on Jul. 31, 2020, which designated the U.S. and claims the benefit of priority from Japanese Patent Application No. 2019-144656 filed on Aug. 6, 2019. The entire disclosures of all of the above applications are incorporated herein by reference.

TECHNICAL FIELD

The present disclosure relates to a heat exchanger.

BACKGROUND

A heat exchanger includes flat tubes and corrugated fins each of which is arranged between adjacent ones of the flat tubes. The corrugated fins are joined to the flat tubes and an air flows through gaps of the corrugated fins. Each of the corrugated fins defines multiple louvers as a heat transfer promoter. Each of the corrugated fins further defines fluid passages on a surface of the corrugated fin between the louvers and a joint between the tube and the corrugated fin.

SUMMARY

A heat exchanger includes a plurality of tubes through which a first fluid flows and a corrugated fin configured to improve heat exchange efficiency between the first fluid flowing through the plurality of tubes and a second fluid flowing outside of the plurality of tubes. The corrugated fin includes a plurality of bending portions connected to adjacent two tubes of the plurality of tubes and a plurality of fin body portions each extending between the adjacent two tubes. Each of the plurality of fin body portions defines a plurality of grooves on a surface thereof. Each of the plurality of grooves extends in an extending direction from one of the adjacent two tubes toward the other of the adjacent two tubes. Each of the plurality of fin body portions includes a protrusion disposed at an intermediate position of at least one of the plurality of grooves between the adjacent two tubes in the extending direction. The protrusion protrudes from a bottom of the at least one of the plurality of grooves toward the surface.

A heat exchanger includes a plurality of tubes through which a first fluid flows and a corrugated fin configured to improve heat exchange efficiency between the first fluid flowing through the plurality of tubes and a second fluid flowing outside of the plurality of tubes. The corrugated fin includes a plurality of bending portions connected to adjacent two tubes of the plurality of tubes and a plurality of fin body portions each extending between the adjacent two tubes. Each of the plurality of fin body portions defines a plurality of grooves each extending in an extending direction from one of the adjacent two tubes toward the other of the adjacent two tubes. Each of the plurality of grooves between the adjacent two tubes has a predetermined width. At least one of the plurality of grooves has a narrow portion at an intermediate position of the at least one of the plurality of grooves between the adjacent two tubes in the extending direction. The narrow portion has a width narrower than the predetermined width.

A heat exchanger includes a plurality of tubes through which a first fluid flows and a corrugated fin configured to improve heat exchange efficiency between the first fluid flowing through the plurality of tubes and a second fluid flowing outside of the plurality of tubes. The corrugated fin includes a plurality of bending portions connected to adjacent two tubes of the plurality of tubes and a plurality of fin body portions each extending between the adjacent two tubes. Each of the fin body portions defines a plurality of grooves on a surface thereof. Each of the plurality of grooves extends in an extending direction from one of the adjacent two tubes toward the other of the adjacent two tubes. At least two of the plurality of grooves in parallel with each other are merged at a merging portion. The merging portion is fluidly connected to one end of a hydrophilicity reducing portion in the extending direction. An other end of the hydrophilicity reducing portion in the extending direction is fluidly connected to a branching portion from which at least two of the plurality of grooves in parallel with each other branch off. The hydrophilicity reducing portion is configured to reduce a hydrophilicity of a portion of the surface between the merging portion and the branching portion to less than that of a portion of the surface where the at least two of the plurality of grooves merged at the merging portion and the at least two of the plurality of grooves branching from the branching portion are formed.

DESCRIPTION OF EMBODIMENTS

To begin with, examples of relevant techniques will be described.

A heat exchanger includes flat tubes and corrugated fins each of which is arranged between adjacent ones of the flat tubes. The corrugated fins are joined to the flat tubes and an air flows through gaps of the corrugated fins. Each of the corrugated fins defines multiple louvers as a heat transfer promoter. Each of the corrugated fins further defines fluid passages on a surface of the corrugated fin between the louvers and a joint between the tube and the corrugated fin. In this heat exchanger, water staying on peaks of the corrugated fin flows vertically downward through the fluid passages.

The heat exchanger cannot effectively drain the condensed water staying in a central portion of the corrugated fin between two adjacent flat tubes.

Figure 21:
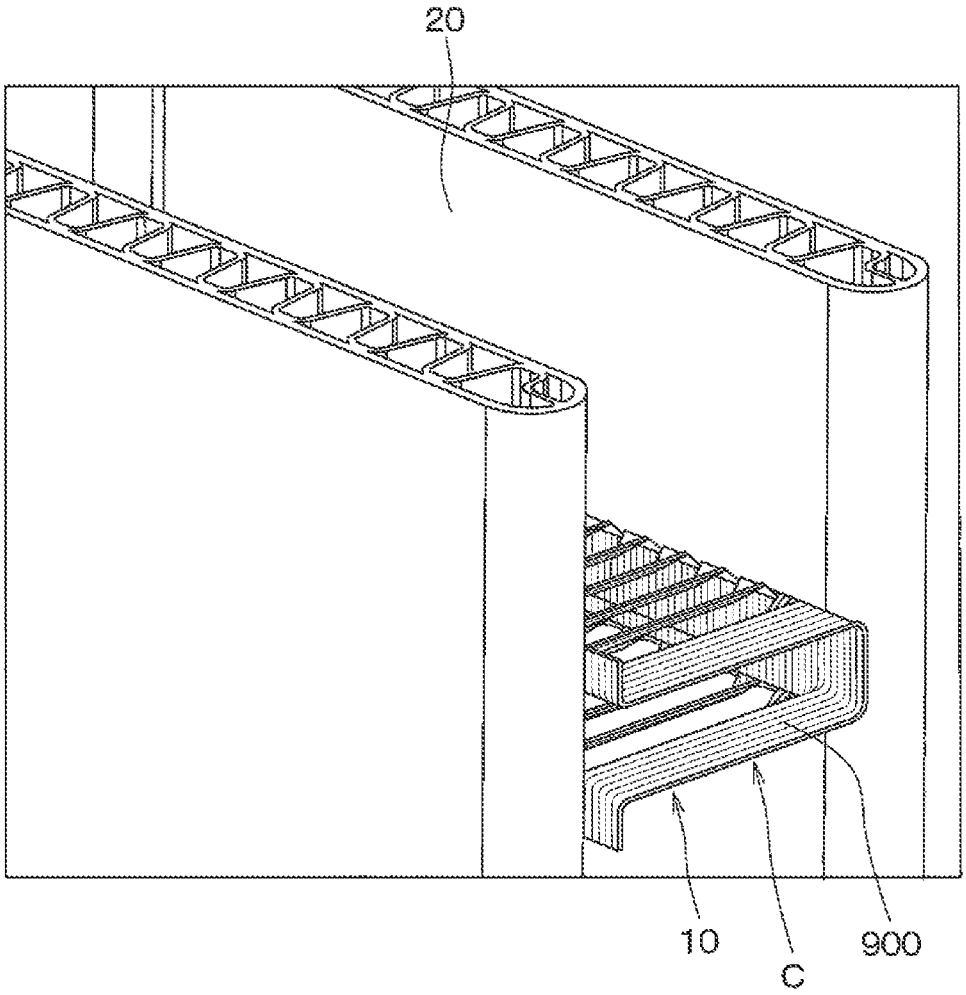
FIG. 21 is a diagram for explaining a problem.

Therefore, as shown in FIG. 21, it is considered that the corrugated fin 10 disposed between the adjacent two tubes 20 defines multiple grooves 900 on a surface of the corrugated fin 10 to improve hydrophilicity of the surface. The grooves 900 can improve the surface of the hydrophilicity of the corrugated fin 10, so that condensed water staying in the center portion C of the corrugated fin 10 between the adjacent two tubes 20 can be effectively drained.

However, in the heat exchanger defining such grooves, if the amount of condensed water that flows to the corrugated fin 10 along the tube 20 is small, the grooves may assist the condensed water in flowing to the center portion C of the corrugated fin 10 between the adjacent two tubes 20. Actually, drainability is lowered.

It is objective of the present disclosure to improve drainability of the corrugated fin.

According to one aspect of the present disclosure, a heat exchanger includes a plurality of tubes through which a first fluid flows and a corrugated fin configured to improve heat exchange efficiency between the first fluid flowing through the plurality of tubes and a second fluid flowing outside of the plurality of tubes. The corrugated fin includes a plurality of bending portions connected to adjacent two tubes of the plurality of tubes and a plurality of fin body portions each extending between the adjacent two tubes. Each of the plurality of fin body portions defines a plurality of grooves on a surface thereof. Each of the plurality of grooves extends in an extending direction from one of the adjacent two tubes toward the other of the adjacent two tubes. Each of the plurality of fin body portions includes a protrusion disposed at an intermediate position of at least one of the plurality of grooves between the adjacent two tubes in the extending direction. The protrusion protrudes from a bottom of the at least one of the plurality of grooves toward the surface.

According to the above-described configuration, the protrusion protruding from the bottom of the at least one of the plurality of grooves toward the surface is disposed at the intermediate position of the at least one of the grooves between the adjacent two tubes in the extending direction. Therefore, when the amount of the condensed water generated on the tubes is small, the condensed water from the tubes 20 can be inhibited from flowing to the center portion of the corrugated fin between the adjacent tubes.

According to another aspect of the present disclosure, a heat exchanger includes a plurality of tubes through which a first fluid flows and a corrugated fin configured to improve heat exchange efficiency between the first fluid flowing through the plurality of tubes and a second fluid flowing outside of the plurality of tubes. The corrugated fin includes a plurality of bending portions connected to adjacent two tubes of the plurality of tubes and a plurality of fin body portions each extending between the adjacent two tubes. Each of the plurality of fin body portions defines a plurality of grooves each extending in an extending direction from one of the adjacent two tubes toward the other of the adjacent two tubes. Each of the plurality of grooves between the adjacent two tubes has a predetermined width. At least one of the plurality of grooves has a narrow portion at an intermediate position of the at least one of the plurality of grooves between the adjacent two tubes in the extending direction. The narrow portion has a width narrower than the predetermined width.

According to the above-described configuration, at least one of the plurality of grooves has the narrow portion at the intermediate position thereof in the extending direction. The narrow portion has a width narrower than the predetermined width. Therefore, when the amount of the condensed water generated on the tubes is small, the condensed water from the tubes can be inhibited from flowing to the center portion of the corrugated fin between the adjacent tubes.

Moreover, according to another aspect of the present disclosure, a heat exchanger includes a plurality of tubes through which a first fluid flows and a corrugated fin configured to improve heat exchange efficiency between the first fluid flowing through the plurality of tubes and a second fluid flowing outside of the plurality of tubes. The corrugated fin includes a plurality of bending portions connected to adjacent two tubes of the plurality of tubes and a plurality of fin body portions each extending between the adjacent two tubes. Each of the fin body portions defines a plurality of grooves on a surface thereof. Each of the plurality of grooves extends in an extending direction from one of the adjacent two tubes toward the other of the adjacent two tubes. At least two of the plurality of grooves in parallel with each other are merged at a merging portion. The merging portion is fluidly connected to one end of a hydrophilicity reducing portion in the extending direction. An other end of the hydrophilicity reducing portion in the extending direction is fluidly connected to a branching portion from which at least two of the plurality of grooves in parallel with each other branch off. The hydrophilicity reducing portion is configured to reduce a hydrophilicity of a portion of the surface between the merging portion and the branching portion to less than that of a portion of the surface where the at least two of the plurality of grooves merged at the merging portion and the at least two of the plurality of grooves branching from the branching portion are formed.

According to the above-described configuration, at least two of the plurality of grooves in parallel with each other are merged at the merging portion. The merging portion is fluidly connected to one end of the hydrophilicity reducing portion in the extending direction. The other end of the hydrophilicity reducing portion in the extending direction is fluidly connected to the branching portion from which at least two of the plurality of grooves in parallel with each other branch off. The hydrophilicity reducing portion is configured to reduce a hydrophilicity of a portion of the surface between the merging portion and the branching portion to less than that of a portion of the surface where the at least two of the plurality of grooves merged at the merging portion and the at least two of the plurality of grooves branching from the branching portion are formed. Therefore, when the amount of the condensed water generated on the tubes is small, the condensed water from the tubes can be inhibited from flowing to the center portion of the corrugated fin between the adjacent tubes.

Embodiments of the present disclosure will now be described with reference to the drawings. Parts that are identical or equivalent to each other in the following embodiments are assigned the same reference numerals and will not be described. In the drawings, there are cases in which hatching indicating a cross-section of a corrugated fin 10 is omitted in order to avoid confusion between lines indicating grooves provided in the corrugated fin 10 and the hatching indicating the cross-section of the corrugated fin 10.

First Embodiment

Figure 1:
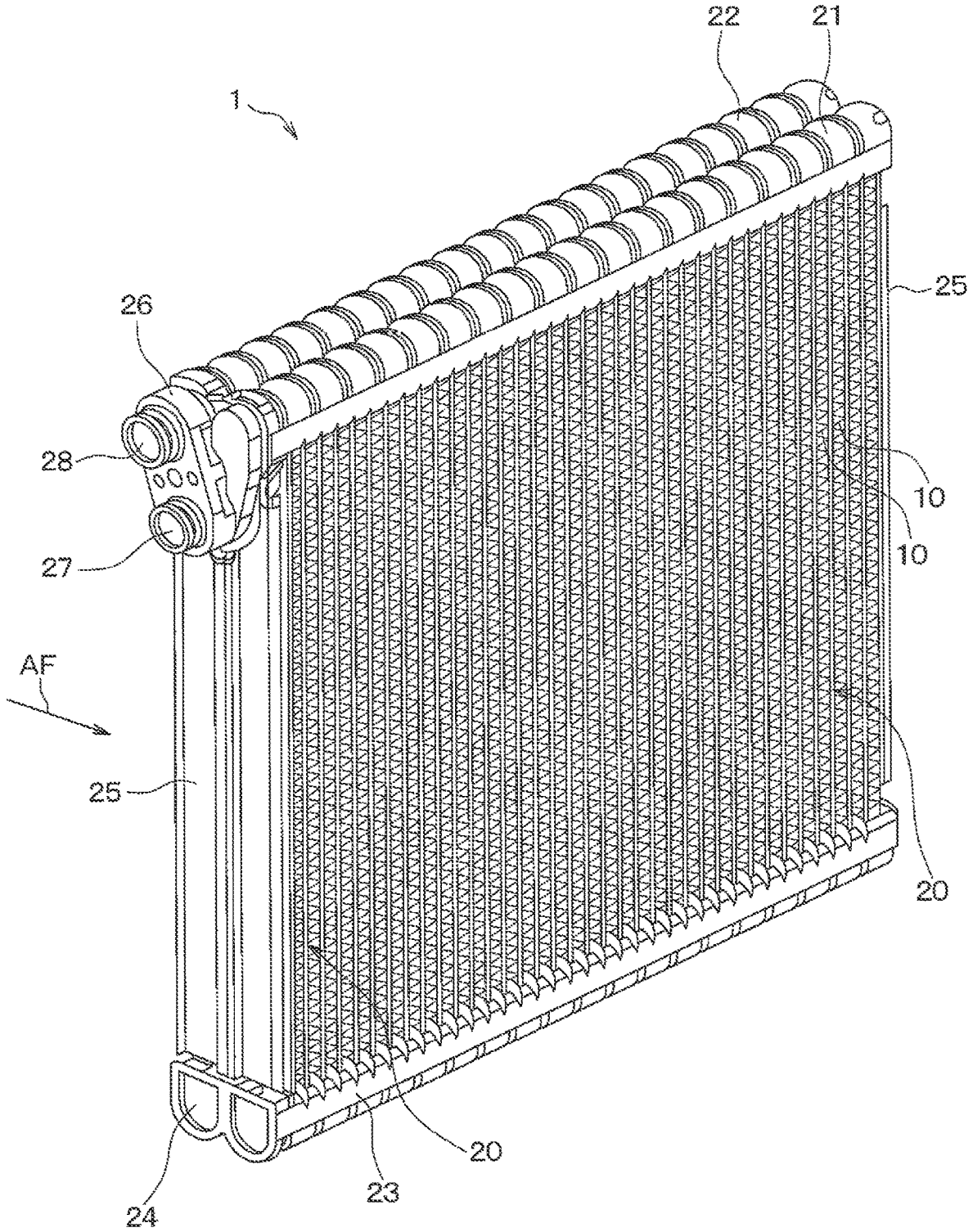
FIG. 1 is a perspective view of a heat exchanger according to a first embodiment.

A first embodiment will be described with reference to the drawings. A heat exchanger 1 according to the present embodiment is used, for example, as an evaporator configuring a part of a refrigeration cycle for performing air-conditioning in a vehicle compartment. The evaporator performs a heat exchange between a refrigerant as a first fluid circulating in the refrigeration cycle and an air as a second fluid passing through the heat exchanger 1, and cools the air by a latent heat of evaporation of the refrigerant. In FIG. 1, a flow direction of the air passing through the heat exchanger 1 is indicated by an arrow AF.

Figure 2:
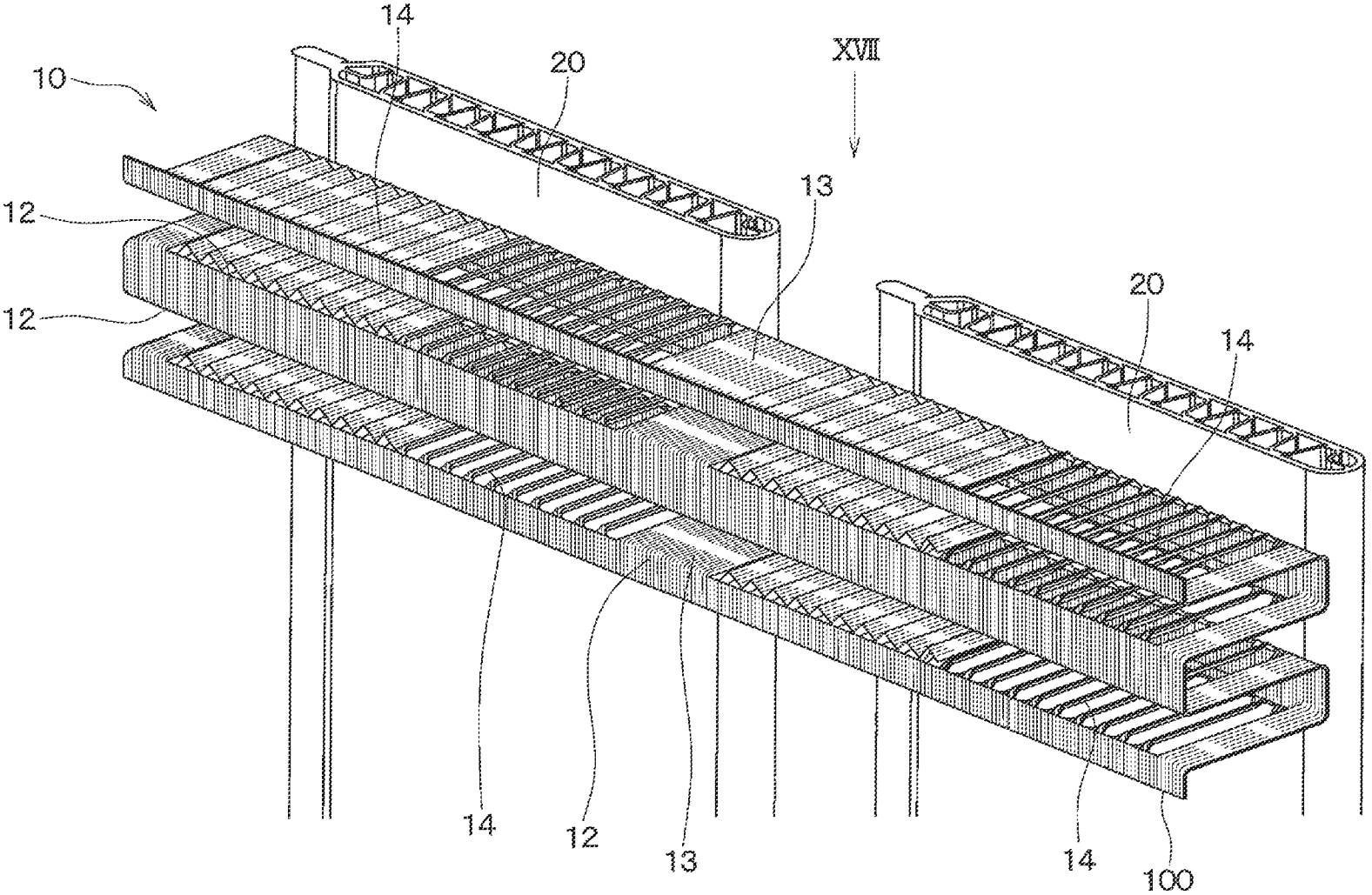
FIG. 2 is a partially enlarged view of the heat exchanger.

As shown in FIGS. 1 and 2, the heat exchanger 1 includes corrugated fins 10, tubes 20, a first header tank 21, a second header tank 22, a third header tank 23, a fourth header tank 24, outer frame members 25, a pipe connection member 26, and the like. Those members are made of aluminum, for example, and the members are joined to each other by brazing.

The multiple tubes 20 are arranged at predetermined intervals in a direction intersecting with an airflow direction. The multiple tubes 20 are arranged in two rows on an upstream side and a downstream side in the airflow direction. Each of the multiple tubes 20 extends linearly from one end to the other end. One end of the multiple tubes 20 is inserted into the first header tank 21 or the second header tank 22, and the other end is inserted into the third header tank 23 or the fourth header tank 24. The first header tank 21, the second header tank 22, the third header tank 23, and the fourth header tank 24 distribute the refrigerant to the multiple tubes 20 and collect the refrigerant flowing in from the multiple tubes 20.

The multiple tubes 20 define air passages through which an air flows therebetween. The corrugated fins 10 are provided respectively in the air passages. In other words, the corrugated fins 10 according to the present embodiment are outer fins provided on the outside of the tubes 20. The corrugated fins 10 increase a heat transfer area between the refrigerant flowing inside the tubes 20 and the air flowing outside the tubes 20, to thereby enhance a heat exchange efficiency between the refrigerant and the air.

The outer frame members 25 are provided outside of the multiple tubes 20 and the multiple corrugated fins 10 in a direction in which the multiple tubes 20 and the multiple corrugated fins 10 are alternately arranged. The pipe connection member 26 is fixed to the outer frame member 25. The pipe connection member 26 defines a refrigerant inlet 27 into which the refrigerant is supplied and a refrigerant outlet 28 for discharging the refrigerant. The refrigerant flows into the first header tank 21 through the refrigerant inlet 27, flows through the first header tank 21, the second header tank 22, the third header tank 23, the fourth header tank 24, and the multiple tubes 20 in a predetermined path, and flows out through the refrigerant outlet 28. At that time, a latent heat of evaporation of the refrigerant flowing through the first to fourth header tanks 21 to 24 and the multiple tubes 20 cools the air flowing through the air passages in which the corrugated fins 10 are arranged.

Figure 3:
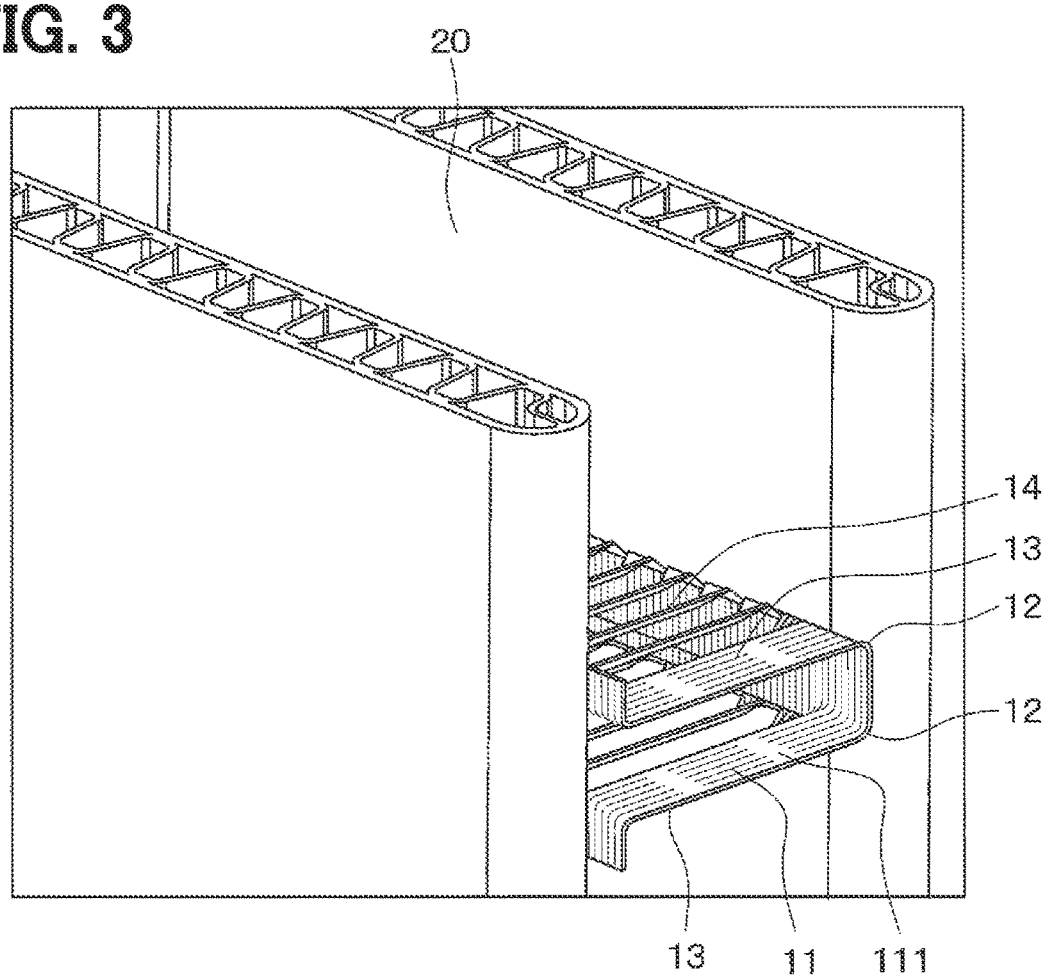
FIG. 3 is a partially enlarged view of the heat exchanger.

FIGS. 2 and 3 are enlarged views of the corrugated fin 10. The corrugated fin 10 has a configuration in which a plate-shaped member 100 is bent at predetermined intervals. The corrugated fin 10 has multiple bending portions 12 and fin body portions 13. The multiple bending portions 12 are portions in which the plate-shaped member 100 configuring the corrugated fin 10 is bent at predetermined intervals. The fin body portions 13 are portions disposed between the bending portion 12 and the bending portion 12. Each of the fin body portions 13 defines multiple louvers 14 each formed by cutting and bending a part of the plate-shaped member 100. An outer wall of the corrugated fin 10 facing the tube 20 is joined to an outer wall of the tube 20 by brazing.

The surface of the corrugated fin 10 defines fine grooves 11 for increasing hydrophilicity. Specifically, the fine grooves 11 are defined on both surfaces of the plate-shaped member 100. The multiple grooves 11 are arranged at predetermined intervals to be separated away from each other. In the drawings referred to in the present embodiment, the multiple grooves 11 defined on the surfaces of the corrugated fin 10 are schematically largely illustrated for the sake of description. This also applies to the drawings referred to in second to sixth embodiments which will be described later.

The multiple grooves 11 are defined in the bending portions 12 and the fin body portions 13 of the corrugated fin 10. The multiple grooves 11 are also defined in the louvers 14. In the present embodiment, in each of the fin body portions 13 having a plate shape, the multiple grooves 11 extend from the bent portion 12 joined to one tube 20 toward the bent portion 12 joined to another tube 20.

A width of each of the grooves 11 is preferably within a range of 10 to 50 μm. A depth of each of the grooves 11 is preferably 10 μm or more. A pitch of the grooves 11 is preferably within a range of 50 to 200 μm. Within these ranges, the hydrophilicity of the surface of the corrugated fin 10 can be improved. When the hydrophilicity of the surface of the corrugated fin 10 is increased, the drainability of the corrugated fin 10 is improved and the condensed water is inhibited from staying on the surface of the corrugated fin 10. Thus, the ventilation resistance of the air passages can avoid increasing due to the condensed water staying in the air passages, so that the heat exchanger 1 can improve the heat exchanging performance.

Figure 4:
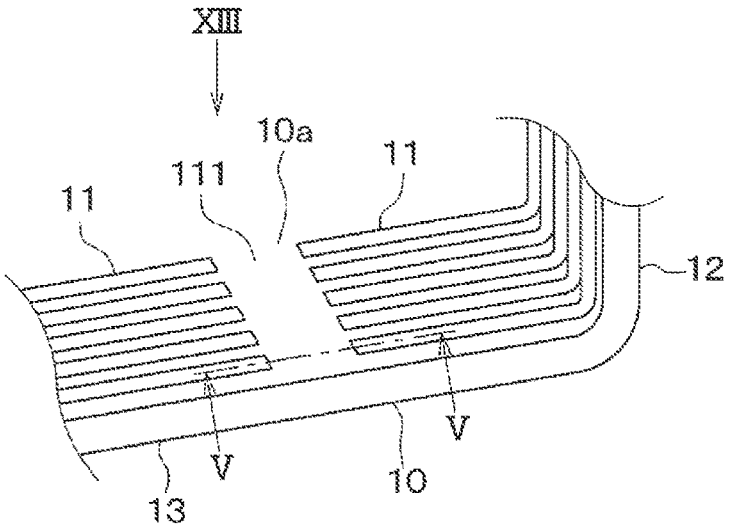
FIG. 4 is a partially enlarged view of a corrugated fin.
Figure 5:
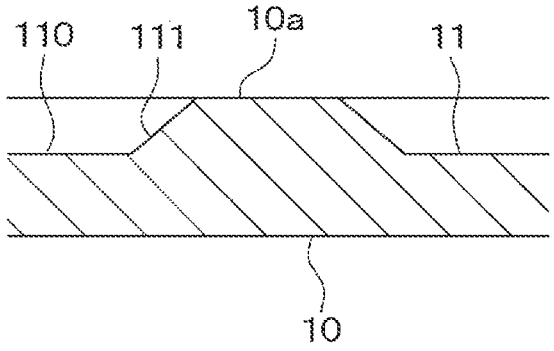
FIG. 5 is a cross-sectional view taken along a line V-V in FIG. 4.

As shown in FIGS. 3 to 5, the corrugated fin 10 of the present embodiment includes two protrusions 111 arranged in an intermediate position of each of the multiple grooves 11 between the two bending portions 12 joined to the two tubes 20. The two protrusions 111 protrude to reach the surface 10*a* of the corrugated fin 10. In other words, the protrusions 111 divide each of the grooves 11 at two points between the two bending portions 12 joined to the two tubes 20.

Figure 6:
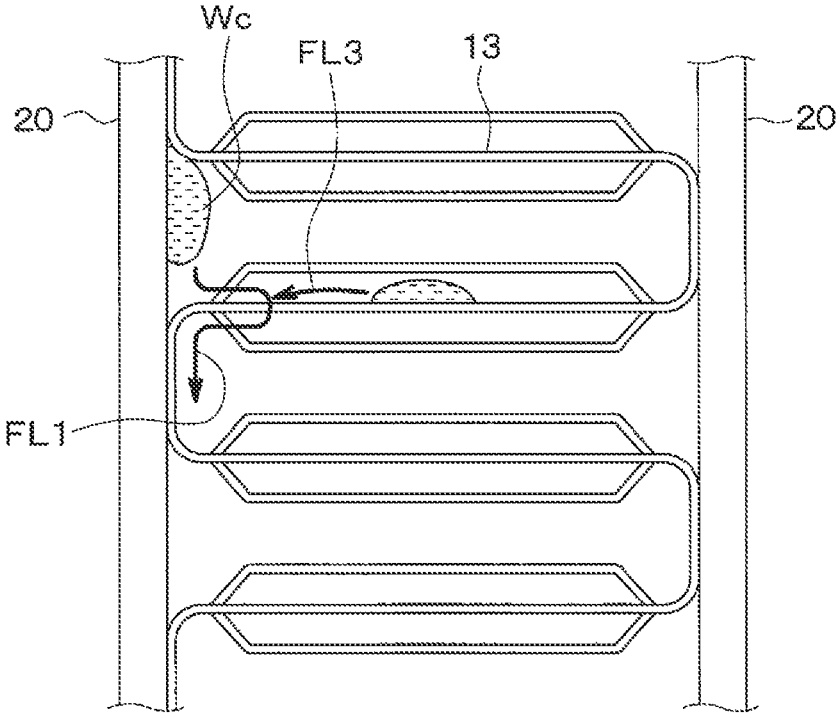
FIG. 6 is a diagram illustrating a flow of condensed water in a comparative example that does not include a protrusion in an intermediate position of grooves.

FIG. 21 illustrates the configuration in which the protrusion 111 like the present embodiment is not formed in the intermediate position of the grooves 11. In this case, when the amount of condensed water Wc is large, the condensed water Wc generated on the tube 20 flows downward as shown in an arrow FL1 in FIG. 6. Further, the condensed water staying on the center portion of the corrugated fin 10 between the two tubes 20 flows toward the tube 20 through the grooves 11 as shown in an arrow FL3 in FIG. 6.

Figure 7:
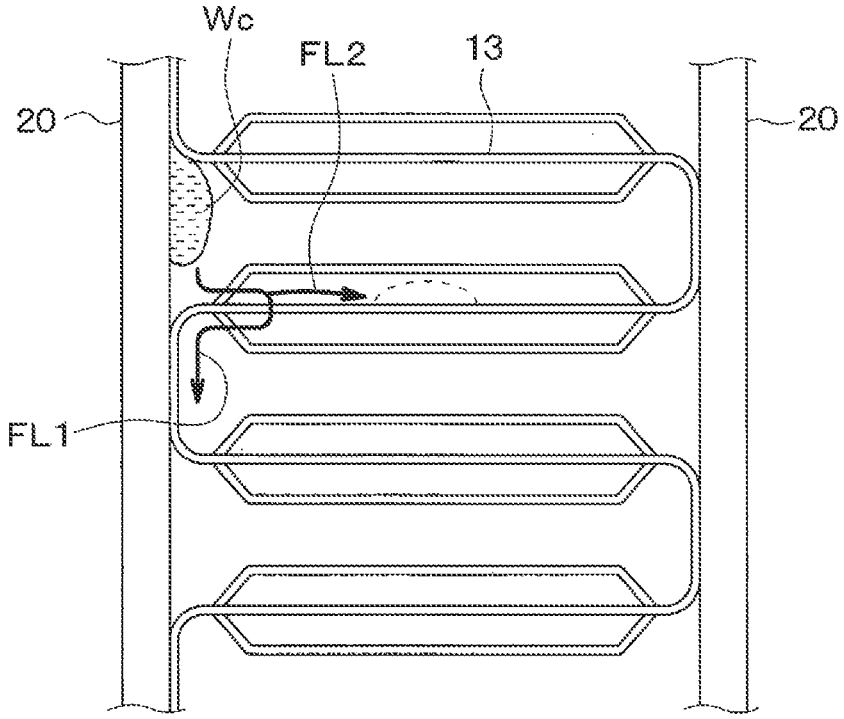
FIG. 7 is a diagram illustrating a flow of condensed water in the comparative example that does not include the protrusion in the intermediate position of grooves.

However, when the amount of condensed water Wc is small, the condensed water Wc generated on the tube 20 flows to reach the center portion of the corrugated fin 10 between the two tubes 20 thorough the grooves 11 as shown in an arrow FL2 in FIG. 7. Actually, the drainability is lowered for this reason.

Figure 9:
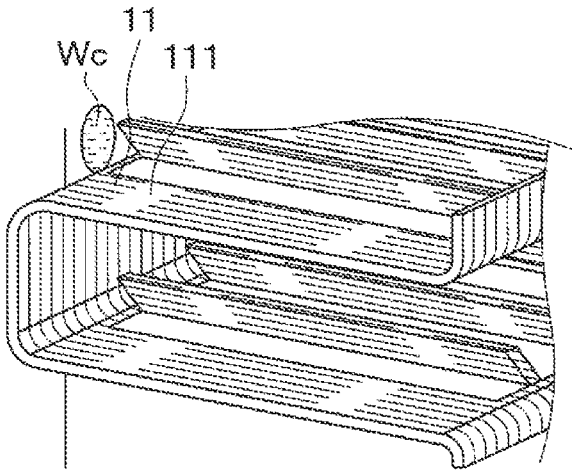
FIG. 9 is a diagram illustrating a state of condensed water in the heat exchanger of the first embodiment.

In contrast, in the corrugated fin 10 of the present embodiment, as shown in FIG. 9, the protrusions 111 are formed at an intermediate position of each of the grooves 11 between the bending portions 12 joined to the two tubes 20.

Figure 8:
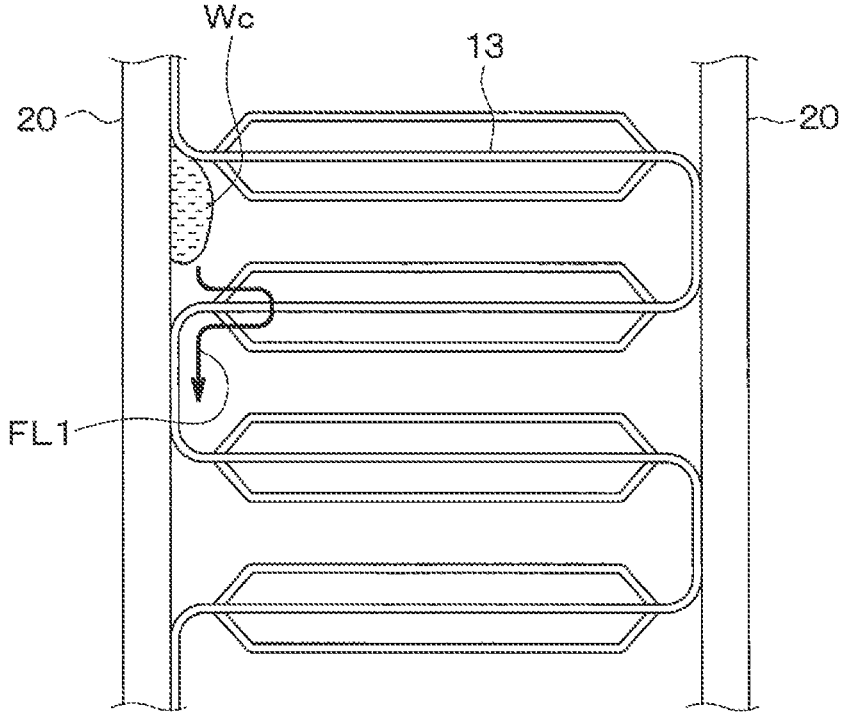
FIG. 8 is a diagram illustrating a flow of condensed water in the heat exchanger according to the first embodiment.

Therefore, when the amount of condensed water Wc is small, as shown in FIGS. 8 and 9, the condensed water Wc generated on the tube 20 can be inhibited from flowing to the central portion of the corrugated fin 10 between the two tubes 20. That is, the protrusions 111 formed at the intermediate positions of the grooves 11 can inhibit the condensed water generated on the tube 20 from flowing to the center portion of the corrugated fin 10 between the two tubes 20.

Figure 10:
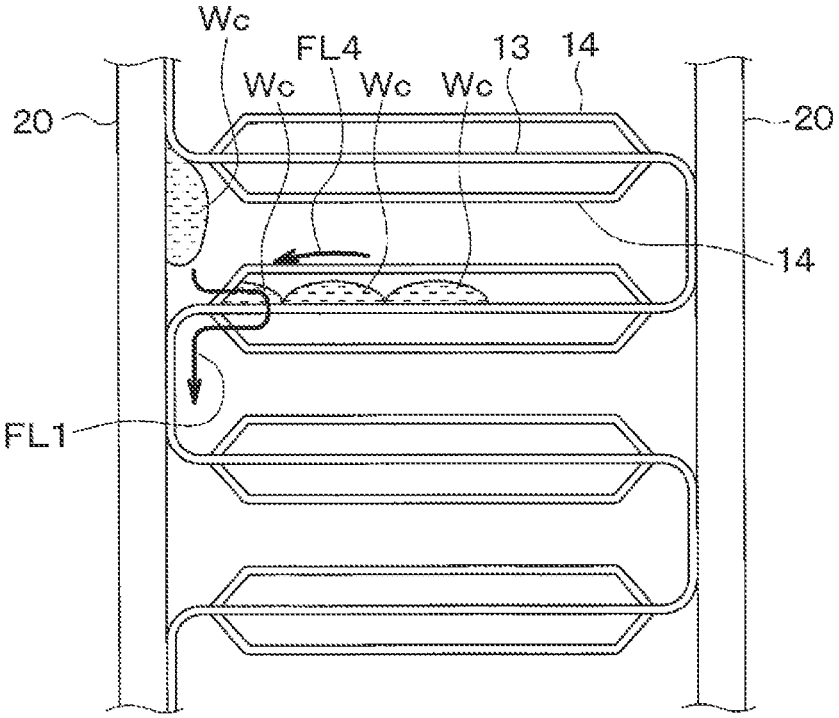
FIG. 10 is a diagram illustrating a flow of condensed water in a configuration in which the protrusions are formed in intermediate positions of the grooves.
Figure 11:
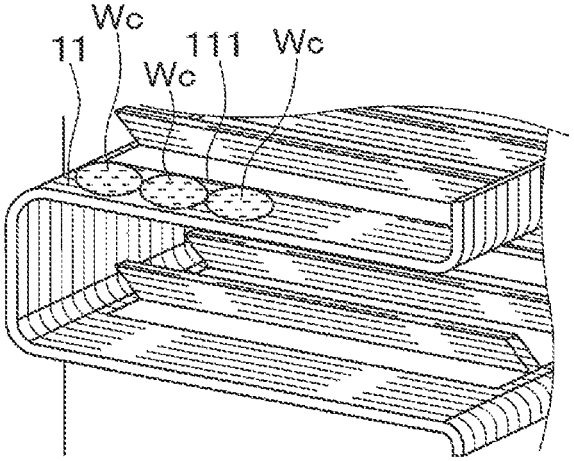
FIG. 11 is a diagram illustrating a state of condensed water in the configuration in which the protrusions are formed in the intermediate positions of the grooves.

Further, as shown in FIGS. 10 and 11, when the amount of condensed water Wc is large and the condensed water Wc stays on the protrusion 111 of the groove 11, the condensed water Wc located on both sides of the protrusion 111 are connected through the condensed water Wc on the protrusion 111 as shown in an arrow FL4 of FIG. 10. Thus, the condensed water Wc staying on the center portion of the corrugated fin 10 between the two tubes 20 flows over the protrusion 111 and flows downward as shown in an arrow FL1 of FIG. 10. Therefore, drainability can be ensured.

As described above, the heat exchanger 1 of the present embodiment includes a plurality of tubes 20 through which a first fluid flows. Further, the heat exchanger 1 includes a corrugated fin 10 configured to improve heat change efficiency between the first fluid flowing through the tubes 20 and a second fluid flowing outside of the tubes 20. Further, the corrugated fin 10 includes a plurality of bending portions 12 connected adjacent two tubes 20 of the plurality of tubes 20. Further, the corrugated fin 10 includes a plurality of fin body portions 13 each extending between the adjacent two tubes 20. Further, each of the plurality of fin body portions 13 defines a plurality of grooves 11 on a surface thereof. Each of the plurality of fin body portions 13 extends in an extending direction from one of the adjacent two tubes 20 toward the other of the adjacent two tubes 20. Each of the plurality of fin body portions 13 further includes the plurality of protrusions 111 disposed at intermediate positions of the plurality of grooves 11 in the extending direction. Each of the plurality of protrusions 111 protrudes from a bottom 110 of the groove 11 toward the surface 10*a* of each of the plurality of fin body portions 13.

As described above, the corrugated fin 10 includes the protrusions 111 at intermediate positions of the grooves 11 in the extending direction. Each of the protrusions 111 protrude from the bottom 110 of the groove 11 toward the surface 10*a* of the fin body portion 13. Therefore, when the amount of the condensed water on the tube 20 is small, the condensed water from the tubes 20 can be inhibited from flowing to reach the center portion of the corrugated fin 10 between the adjacent two tubes 20.

Further, each of the protrusions 111 protrudes from the bottom 110 of the groove 11 to reach the surface 10*a* of the corrugated fin 10. As a result, a hydrophilicity of an area where the protrusion 111 is formed is greatly decreased, so that the condensed water from the tubes 20 is more effectively inhibited from flowing to the center portion of the corrugated fin 10 between the adjacent tubes 20.

Further, in the heat exchanger 1, each of the plurality of grooves 11 has at least two protrusions 111 at intermediate positions in the extending direction.

Thus, it is possible to inhibit the condensed waters on the adjacent tubes 20 from flowing to reach the center portion of the corrugated fin 10 between the adjacent tubes 20.

Second Embodiment

Figure 12:
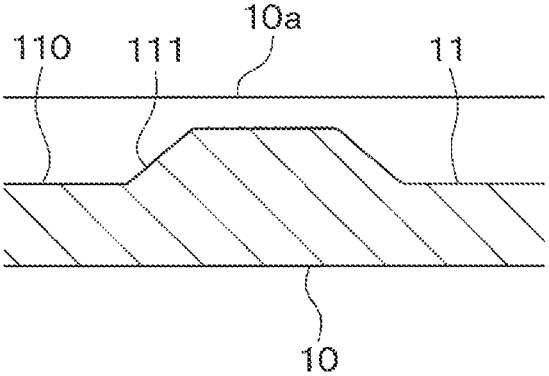
FIG. 12 is a cross-sectional view of a corrugated fin of a heat exchanger of a second embodiment, which corresponds to FIG. 5.

A heat exchanger 1 of a second embodiment will be described with reference to FIG. 12. The protrusion 111 of the first embodiment protrudes from the bottom 110 of the groove 11 to reach the surface 10*a* of the corrugated fin 10. In contrast, in the heat exchanger 1 of the present embodiment, as shown in FIG. 12, the protrusion 111 protrudes from the bottom 110 of the groove 11 to a position lower than the surface 10*a* of the corrugated fin 10.

As described above, even if the protrusion 111 does not protrude to reach the surface 10*a* of the corrugated fin 10 from the bottom 110 of the groove 11, the condensed water Wc generated on the tube 20 can be inhibited from flowing to the center portion of the corrugated fin 10 between the two tubes 20.

The present embodiment can achieve the effects and advantages which are obtained from the structure common to the first embodiment.

Third Embodiment

Figure 13:
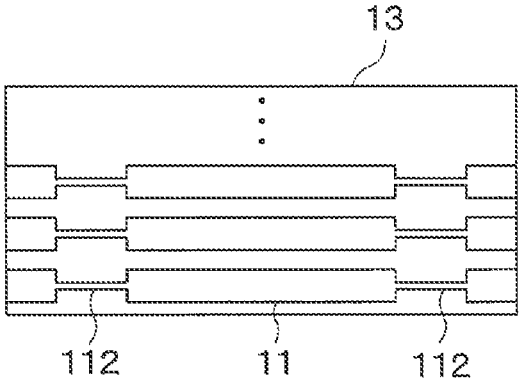
FIG. 13 is an external view of a fin body portion of a corrugated fin of a heat exchanger of a third embodiment that is viewed in a direction of an arrow XIII in FIG. 4.

A heat exchanger 1 of a third embodiment will be described with reference to FIG. 13. In the heat exchanger 1 of the present embodiment, narrow portions 112 each having a width narrower than that of each of the grooves 11 are provided.

Each of the grooves 11 extending between the adjacent two tubes 20 has a predetermined width.

Further, each of the grooves 11 has narrow portions 112 at an intermediate position of each of the grooves 11 in the extending direction. Each of the narrow portions 112 has a width narrower than the predetermined width.

Therefore, when the amount of condensed water Wc is small, the narrow portions 112 inhibit the condensed water generated on the tubes 20 from flowing to the center portion of the corrugated fin 10 between the two tubes 20. That is, the narrow portions 112 formed at the intermediate position of each of the grooves 11 inhibit the condensed water generated on the tubes 20 from flowing to reach the center portion of the corrugated fin 10 between the tubes 20.

As described above, the heat exchanger 1 of the present embodiment includes a plurality of tubes 20 through which a first fluid flows. Further, the heat exchanger 1 includes a corrugated fin 10 configured to improve heat change efficiency between the first fluid flowing through the tubes 20 and a second fluid flowing outside of the tubes 20. Further, the corrugated fin 10 includes a plurality of bending portions 12 connected adjacent two tubes 20 of the plurality of tubes 20. Further, the corrugated fin 10 includes a plurality of fin body portions 13 each extending between the adjacent two tubes 20. Further, each of the fin body portions 13 defines multiple grooves 11 each extending in an extending direction from one of the adjacent two tubes 20 toward the other of the adjacent two tubes 20. Further, each of the grooves 11 between the adjacent two tubes 20 has a predetermined width. Then, each of the grooves 11 has the narrow portions 112 disposed at an intermediate position of each of the grooves 11 in the extending direction. Each of the narrow portions 112 has a width narrower than the predetermined width.

According to the above-described configuration, each of the grooves 11 has the narrow portions 112 at an intermediate position of each of the grooves 11 in the extending direction. Each of the narrow portions 112 has a width narrower than the predetermined width. Therefore, when the amount of the condensed water on the tubes 20 is small, the condensed water from the tubes 20 can be inhibited from flowing to reach the center portion of the corrugated fin 10 between the adjacent two tubes 20.

Further, when the amount of condensed water is large and the condensed water stays on a portion of the groove 11 where the narrow portion 112 is formed, the condensed waters on both sides of the narrow portion 112 are connected through the condensed water on the narrow portion 112. Thus, the condensed water staying on the center portion of the corrugated fin 10 between the two tubes 20 flows over the narrow portion 112 and further flows downward. Therefore, drainability can be ensured.

Further, in the heat exchanger 1, each of the grooves 11 has two narrow portions 112 at intermediate positions of each of the grooves 11 in the extending direction.

Thus, it is possible to inhibit the condensed waters on the adjacent tubes 20 from flowing to reach the center portion of the corrugated fin 10 between the adjacent tubes 20.

Fourth Embodiment

Figure 14:
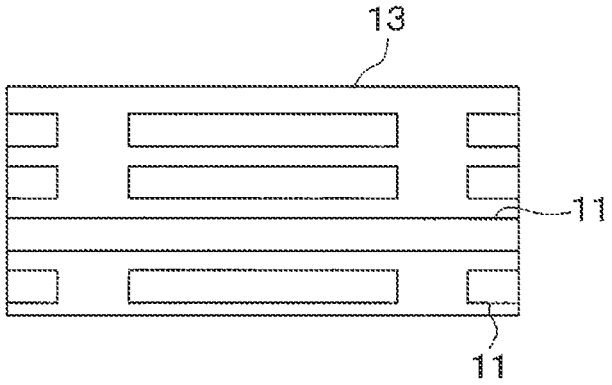
FIG. 14 is an external view of a fin body portion of a corrugated fin of a heat exchanger of a fourth embodiment, which corresponds to FIG. 13.

A heat exchanger 1 of a fourth embodiment will be described with reference to FIG. 14. The heat exchanger 1 of the present embodiment is different from the heat exchanger 1 of the first embodiment in that at least one of the grooves 11 does not include the protrusion 111.

At least one of the grooves 11 does not have to include the protrusion 111.

The present embodiment can achieve the effects and advantages which are obtained from the structure common to the first embodiment.

Fifth Embodiment

Figure 15:
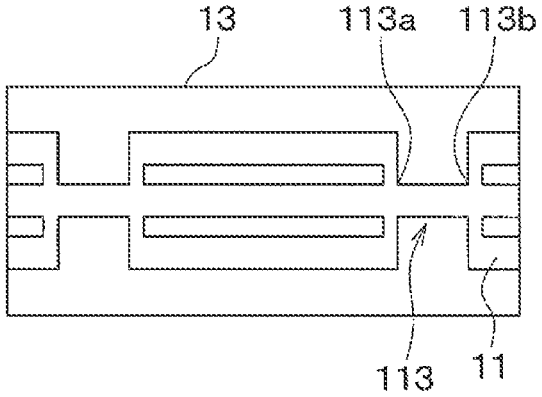
FIG. 15 is an external view of a fin body portion of a corrugated fin of a heat exchanger of a fifth embodiment, which corresponds to FIG. 13.

A heat exchanger 1 of a fifth embodiment will be described with reference to FIG. 15. The heat exchanger 1 of the present embodiment includes a merging portion 113*a* and a branching portion 113*b* that are arranged at an intermediate position of each of the fin body portions 13 between the adjacent two tubes 20. At least two grooves 11 in parallel with each other of the grooves 11 are merged at the merging portion 113*a*. At least two grooves 11 in parallel with each other of the grooves 11 branch off from the branching portion 113*b*. The merging portion 113*a* and the branching portion 113*b* are fluidly connected to each other. Specifically, the merging portion 113*a* and the branching portion 113*b* are fluidly connected through a hydrophilicity reducing portion 113. The hydrophilicity reducing portion 113 is configured to reduce a hydrophilicity of a portion of the surface of the corrugated fin 10 between the merging portion 113*a* and the branching portion 113*b* to less than that of a portion of the surface where the grooves 11 are formed.

Therefore, when the amount of the condensed water from the tubes 20 is small, the hydrophilicity reducing portion 113 can inhibit the condensed water generated on the tubes 20 from flowing to reach the center portion of the corrugated fin 10 between the adjacent tubes 20.

Further, there are two hydrophilicity reducing portions 113 arranged in the extending direction between the two tubes 20.

As described above, the heat exchanger 1 of the present embodiment includes a plurality of tubes 20 through which a first fluid flows. Further, the heat exchanger 1 includes the corrugated fin 10 configured to improve heat change efficiency between the first fluid flowing through the tubes 20 and the second fluid flowing outside of the tubes 20. Further, the corrugated fin 10 includes a plurality of bending portions 12 connected to adjacent two tubes of the plurality of tubes 20 and a plurality of fin body portions 13 each extending between the adjacent two tubes 20. Further, each of the plurality of fin body portions 13 defines a plurality of grooves 11 on a surface thereof. Each of the plurality of fin body portions 13 extends in an extending direction from one of the adjacent two tubes 20 toward the other of the adjacent two tubes 20. Further, at least two of the plurality of grooves 11 in parallel with each other are merged at a merging portion 113*a*. The merging portion 113*a* is fluidly connected to one end of a hydrophilicity reducing portion in the extending direction. An other end of the hydrophilicity reducing portion 113 in the extending direction is fluidly connected to a branching portion from which at least two of the plurality of grooves 11 in parallel with each other branch off. The hydrophilicity reducing portion 113 is configured to reduce a hydrophilicity of a portion of the surface between the merging portion 113*a* and the branching portion to less than that of a portion of the surface where the at least two of the plurality of grooves merged at the merging portion 113*a* and the at least two of the plurality of grooves branching from the branching portion 113*b* are formed.

According to the above-described configuration, the merging portion 113*a* and the branching portion 113*b* are formed at an intermediate portion of each of the plurality of fin body portions in the extending direction.

Then, the hydrophilicity reducing portion 113 is configured to reduce a hydrophilicity of a portion of the surface between the merging portion 113*a* and the branching portion 113*b* to less than that of a portion of the surface where the at least two of the plurality of grooves merged at the merging portion 113*a* and the at least two of the plurality of grooves branching from the branching portion 113*b* are formed. Therefore, when the amount of the condensed water on the tube 20 is small, the condensed water from the tubes 20 can be inhibited from flowing to reach the center portion of the corrugated fin 10 between the adjacent two tubes 20.

Further, there are two hydrophilicity reducing portions 113 arranged at the intermediate portion in the extending direction between the adjacent two tubes 20.

Thus, it is possible to inhibit the condensed waters on the adjacent tubes 20 from flowing to reach the center portion of the corrugated fin 10 between the adjacent tubes 20.

Sixth Embodiment

Figure 16:
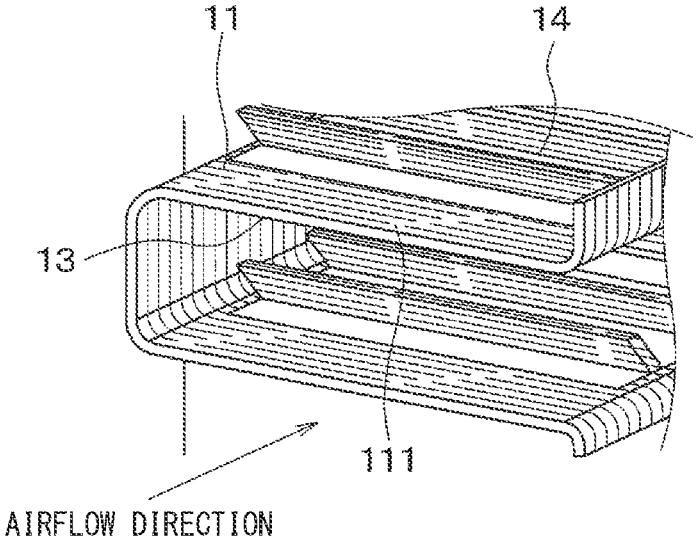
FIG. 16 is an external view of a corrugated fin of a heat exchanger according to a sixth embodiment.

A heat exchanger 1 of a sixth embodiment will be described with reference to FIGS. 16 to 20. The heat exchanger 1 of this embodiment is shown in FIG. 16. FIGS.

17 to 20 are diagrams of each of the fin body portions 13 and the adjacent two tubes 20 viewed in an XVII direction in FIG. 2. Further, each of FIGS. 17 to 20 illustrates a state in which the plate-shaped member 100 before the louvers 14 are formed is arranged between the adjacent two tubes 20. It should be noted that FIGS. 17 to 20 illustrate grooves 140 for forming the louvers 14.

Figure 17:
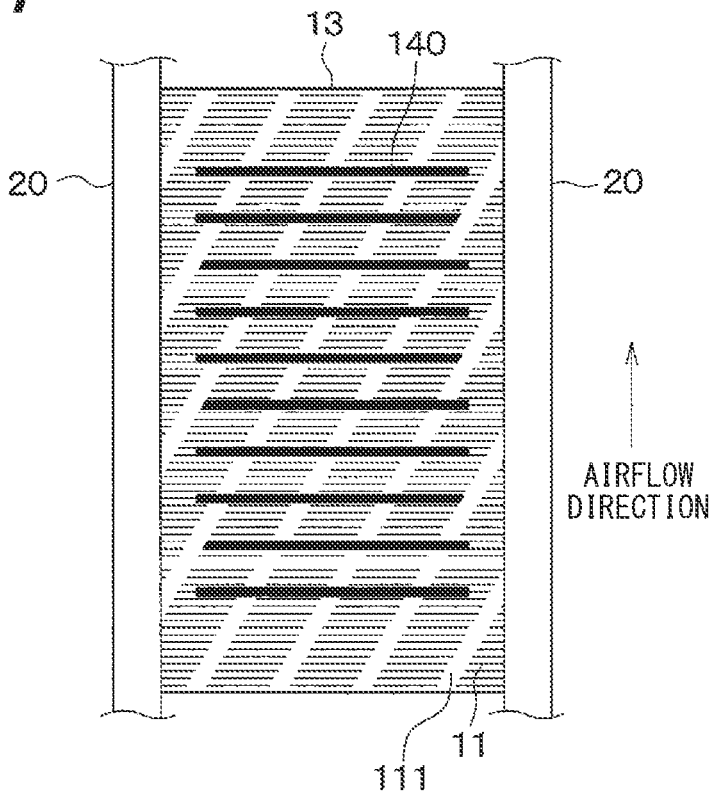
FIG. 17 is a diagram schematically illustrating the corrugated fin of the heat exchanger according to the sixth embodiment.

As shown in FIG. 16, in the heat exchanger 1, the protrusions 111 are diagonally arranged from one of the adjacent two tubes 20 toward the other of the adjacent two tubes 20 relative to a direction perpendicular to the extending direction of the grooves 11 along the surface of each of the fin body portions 13. That is, in the heat exchanger 1, as shown in FIG. 17, the areas where the protrusions 111 are formed are diagonally arranged between the adjacent two tubes 20.

Figure 18:
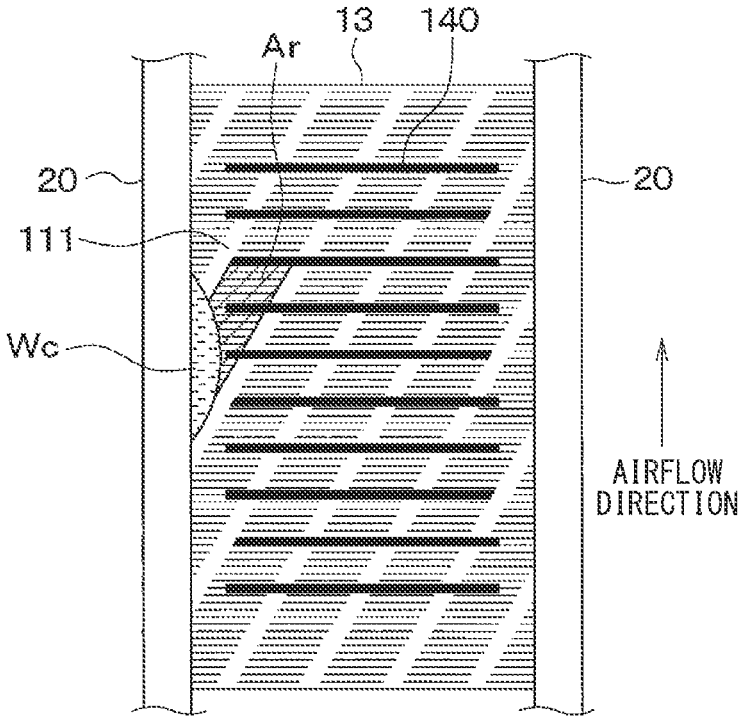
FIG. 18 is a diagram illustrating an area where condensed water stays in the heat exchanger of the sixth embodiment.

When air flows in an airflow direction shown in FIG. 18, in the heat exchanger 1, the condensed water generated on the tube 20 is blocked in the area where the protrusions 111 are formed, retained in an area Ar, and flows downward through a gap of the louver 14. The area Ar where the condensed water is retained is relatively small. Thus, better drainability can be obtained.

Figure 19:
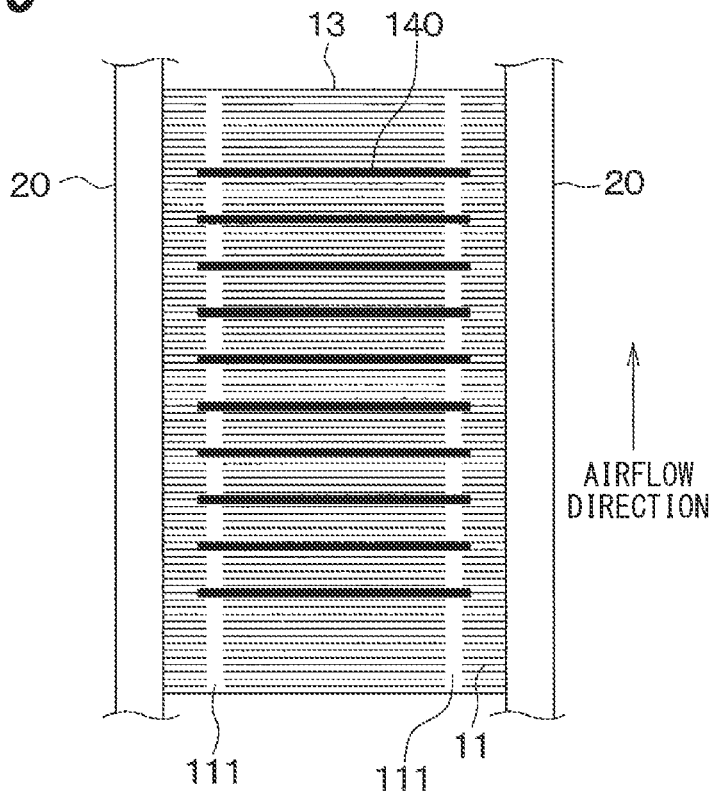
FIG. 19 is a diagram of a corrugated fin of a heat exchanger of a comparative example relative to the sixth embodiment.
Figure 20:
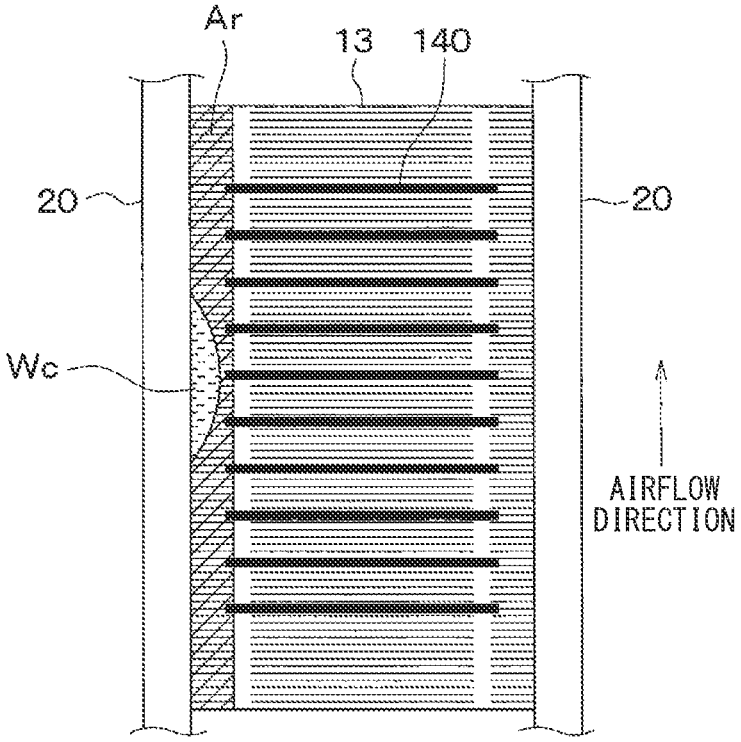
FIG. 20 is a diagram illustrating an area where condensed water stays in the corrugated fin of the comparative example.

FIG. 19 illustrates a comparative example in which the areas where the protrusions 111 are arranged in a direction perpendicular to the extending direction of the grooves 11 along the surface of each of the fin body portions 13.

In the configuration shown in FIG. 19, when air flows in the airflow direction shown in FIG. 19, the condensed water generated on the tube 20 is retained in a relatively large area Ar. Therefore, good drainability cannot be obtained.

In the present embodiment, the protrusions 111 are diagonally arranged from one of the adjacent two tubes 20 toward the other of the adjacent two tubes 20 relative to a direction perpendicular to the extending direction of the grooves 11 along the surface of each of the fin body portions 13.

Alternatively, areas where the narrow portions 112 or the hydrophilicity reducing portions 113 are formed may be diagonally arranged from one of the adjacent two tubes 20 to the other of the adjacent two tubes 20 relative to the direction perpendicular to the extending direction of the grooves 11 along the surface of the each of the fin body portions 13.

Other Embodiments (1) In each of the above embodiments, each of the grooves 11 has two protrusions 111 or two narrow portions 112. Alternatively, two hydrophilicity reducing portions 113 are arranged in the extending direction. However, the number of the protrusions 111, the narrow portions 112, and the hydrophilicity reducing portions 113 is not limited to two.

(2) In the third embodiment, the narrow portion 112 having a width narrower than that of the groove 11 is arranged in an intermediate position of each of the grooves 11. Alternatively, the width of the narrow portion 112 may be zero. That is, each of the grooves 11 may be divided into three grooves by the narrow portions 112.

The present disclosure is not limited to the above embodiments but can be modified as appropriate within the scope described in the present disclosure. The above embodiments are not unrelated to each other and can be appropriately combined unless the combination is obviously impossible. Further, in each of the above-mentioned embodiments, it goes without saying that components of the embodiment are not necessarily essential except for a case in which the components are particularly clearly specified as essential components, a case in which the components are clearly considered in principle as essential components, and the like. A quantity, a value, an amount, a range, or the like, if specified in the above-described example embodiments, is not necessarily limited to the specific value, amount, range, or the like unless it is specifically stated that the value, amount, range, or the like is necessarily the specific value, amount, range, or the like, or unless the value, amount, range, or the like is obviously necessary to be the specific value, amount, range, or the like in principle. Further, in each of the embodiments described above, when referring to the material, shape, positional relationship, and the like of the components and the like, except in the case where the components are specifically specified, and in the case where the components are fundamentally limited to a specific material, shape, positional relationship, and the like, the components are not limited to the material, shape, positional relationship, and the like.

Overview

According to the first aspect shown in part or all of each of the above embodiments, the heat exchanger includes a plurality of tubes through which a first fluid flows. The heat exchanger further includes a corrugated fin that is configured to improve heat exchange efficiency between the first fluid flowing through the plurality of tubes and a second fluid flowing outside of the plurality of tubes. Further, the corrugated fin has a plurality of bending portions connected adjacent two tubes of the plurality of tubes. Further, the corrugated fin has a plurality of fin body portions each arranged between the adjacent two tubes. Further, each of the plurality of fin body portions defines a plurality of grooves on a surface thereof. Each of the plurality of grooves extends in an extending direction from one of the adjacent two tubes toward the other of the adjacent two tubes. Further, each of the plurality of fin plurality of fin body portions includes a protrusion disposed at an intermediate position of at least one of the plurality of grooves in the extending direction. The protrusion protrudes from a bottom of the at least one of the plurality of grooves toward the surface of each of the plurality of fin body portions.

Further, according to the second aspect, the protrusion protrudes from the bottom of the at least one of the grooves to reach the surface of the corrugated fin. Thereby, a hydrophilicity of an area where the protrusion is formed is significantly decreased and the condensed water generated on the tube is effectively inhibited from flowing to a center portion of the corrugated fin between the adjacent two tubes.

Also, according to a third aspect, in the heat exchanger, the protrusion includes at least two protrusions arranged at intermediate positions of one of the multiple grooves between the adjacent two tubes in the extending direction.

Thus, it is possible to inhibit the condensed water generated on the adjacent two tubes from flowing to the center portion of the corrugated fin between the adjacent two tubes.

Further, according to a fourth aspect, each of the fin body portions includes multiple louvers each formed by cutting and bending a part of each of the fin body portions. The protrusions of each of the fin body portions are diagonally arranged from one of the adjacent two tubes toward the other of the adjacent two tubes relative to a direction perpendicular to the extending direction of the grooves along the surface of each of the fin body portions.

Thus, when air flows in the direction perpendicular to the extending direction of the grooves along the surface of each of the fin body portions, the condensed water generated on the tubes are blocked at the protrusions and flows downward through the louvers. Thus, drainability can be improved.

Also, according to a fifth aspect, the heat exchanger includes multiple tubes through which a first fluid flows. The heat exchanger further includes a corrugated fin that is configured to improve heat exchange efficiency between the first fluid flowing through the tubes and a second fluid flowing outside of the tubes. Further, the corrugated fin has multiple bending portions connected adjacent two tubes of the multiple tubes. Further, the corrugated fin has multiple fin body portions each arranged between the adjacent two tubes. Further, each of the fin body portions defines multiple grooves each extending in an extending direction from one of the adjacent two tubes toward the other of the adjacent two tubes. Further, each of the grooves between the adjacent two tubes has a predetermined width. Further, at least one of the grooves has a narrow portion at an intermediate position thereof in the extending direction. The narrow portion has a width narrower than the predetermined width.

Also, according to a sixth aspect, in the heat exchanger, the narrow portions includes at least two narrow portions arranged at intermediate positions of one of the grooves between the adjacent two tubes in the extending direction.

Thus, it is possible to inhibit the condensed water generated on the adjacent two tubes from flowing to the center portion of the corrugated fin between the adjacent two tubes.

Further, according to a seventh aspect, each of the fin body portions includes multiple louvers each formed by cutting and bending a part of each of the fin body portions. Further, the narrow portion is multiple narrow portions formed in the grooves. The narrow portions are diagonally arranged from one of the adjacent two tubes toward the other of the adjacent two tubes relative to a direction perpendicular to the extending direction of the grooves along the surface of each of the fin body portions.

Thus, when air flows in the direction perpendicular to the extending direction of the grooves along the surface of each of the fin body portions, the condensed water generated on the tubes are blocked at the narrow portions and flows downward through the louvers. Thus, drainability can be improved.

Also, according to an eighth aspect, the heat exchanger includes multiple tubes through which a first fluid flows. The heat exchanger further includes a corrugated fin that is configured to improve heat exchange efficiency between the first fluid flowing through the tubes and a second fluid flowing outside of the tubes. Further, the corrugated fin has multiple bending portions connected adjacent two tubes of the multiple tubes. Further, the corrugated fin has multiple fin body portions each arranged between the adjacent two tubes. Further, each of the fin body portions defines multiple grooves on a surface thereof. Each of the multiple grooves extends in an extending direction from one of the adjacent two tubes toward the other of the adjacent two tubes. Further, each of the fin body portions includes a merging portion at which at least two of the grooves in parallel with each other are merged. The merging portion is fluidly connected to one end of a hydrophilicity reducing portion in the extending direction. An other end of the hydrophilicity reducing portion is fluidly connected to a branching portion from which at least two of the plurality of grooves in parallel with each other branch off. The hydrophilicity reducing portion is configured to reduce a hydrophilicity of a portion of the surface between the merging portion and the branching portion 113*b* to less than that of a portion of the surface where the at least two of the grooves merging at the merging portion and the at least two of the grooves branching off from the branching portion are formed.

Further, according to a ninth aspect, the hydrophilicity reducing portion is a plurality of hydrophilicity reducing portions.

Thus, it is possible to inhibit the condensed water generated on the adjacent two tubes from flowing to the center portion of the corrugated fin between the adjacent two tubes.

Further, according to a tenth aspect, each of the fin body portions includes multiple louvers each formed by cutting and bending a part of each of the fin body portions. Further, the hydrophilicity reducing portions are diagonally arranged from one of the adjacent two tubes toward the other of the adjacent two tubes relative to a direction perpendicular to the extending direction of the grooves along the surface of each of the fin body portions.

Thus, when air flows in the direction perpendicular to the extending direction of the grooves along the surface of each of the fin body portions, the condensed water generated on the tubes are blocked at the hydrophilicity reducing portions and flows downward through the louvers. Thus, drainability can be improved.

What is claimed is:

1. A heat exchanger comprising:

a plurality of tubes through which a first fluid flows; and a corrugated fin configured to improve a heat exchange efficiency between the first fluid flowing through the plurality of tubes and a second fluid flowing outside of the plurality of tubes, wherein the corrugated fin includes:

a plurality of bending portions connected to adjacent two tubes of the plurality of tubes; and a plurality of fin body portions extending between the plurality of bending portions, each of the plurality of fin body portions includes:

a plurality of grooves on a surface thereof, each of the plurality of grooves extending in an extending direction from one of the adjacent two tubes toward an other of the adjacent two tubes; and pairs of grooves which are co-linear in the extending direction are separated from each other at an intermediate portion between the two adjacent tubes in the extending direction by a protrusion which extends from one groove of the pair to the other groove of the pair, the protrusions protrude from bottoms of the more than one of the plurality of grooves toward the surface such that the protrusions are arranged in a direction intersecting with the extending direction without a groove interposed between the protrusions, and the plurality of grooves are arranged at predetermined intervals to be separated away from each other.

2. The heat exchanger according to claim 1, wherein the protrusions protrude from bottoms of the more than one of the plurality of grooves to reach the surface.

3. The heat exchanger according to claim 1, wherein the protrusions include at least two protrusions disposed at intermediate positions of one of the plurality of grooves between the adjacent two tubes in the extending direction.

4. The heat exchanger according to claim 1, wherein each of the plurality of fin body portions has a plurality of louvers each formed by cutting and bending a portion of each of the plurality of fin body portions, the protrusions include a plurality of protrusions that are formed in the plurality of grooves, and the plurality of protrusions of the plurality of grooves are diagonally arranged relative to a direction perpendicular to the extending direction from the one of the adjacent two tubes toward the other.

5. A heat exchanger comprising:

a plurality of tubes through which a first fluid flows; and a corrugated fin configured to improve a heat exchange efficiency between the first fluid flowing through the plurality of tubes and a second fluid flowing outside of the plurality of tubes, wherein the corrugated fin includes:

a plurality of bending portions connected to adjacent two tubes of the plurality of tubes; and a plurality of fin body portions extending between the plurality of bending portions, each of the plurality of fin body portions includes a plurality of grooves each extending in an extending direction from one of the adjacent two tubes toward an other of the adjacent two tubes, each of the plurality of grooves has a predetermined width, more than one of the plurality of grooves have narrow portions at intermediate positions of the more than one of the plurality of grooves between the adjacent two tubes in the extending direction, each of the narrow portions having a width narrower than the predetermined width, the narrow portions are arranged in a direction intersecting with the extending direction without a portion of the groove having the predetermined width interposed between the narrow portions, and the plurality of grooves are arranged at predetermined intervals to be separated away from each other.

6. The heat exchanger according to claim 5, wherein the narrow portions include at least two narrow portions disposed at intermediate positions of one of the plurality of grooves between the adjacent two tubes in the extending direction.

7. The heat exchanger according to claim 5, wherein each of the plurality of fin body portions has a plurality of louvers each formed by cutting and bending a portion of each of the plurality of fin body portions, the narrow portions include a plurality of narrow portions formed in the plurality of grooves, and the plurality of narrow portions of the plurality of grooves are diagonally arranged relative to a direction perpendicular to the extending direction from the one of the two tubes toward the other.

8. A heat exchanger comprising:

a plurality of tubes through which a first fluid flows; and a corrugated fin configured to improve a heat exchange efficiency between the first fluid flowing through the plurality of tubes and a second fluid flowing outside of the plurality of tubes, wherein the corrugated fin includes:

a plurality of bending portions connected to adjacent two tubes of the plurality of tubes; and a plurality of fin body portions extending between the plurality of bending portions, each of the plurality of fin body portions includes a plurality of grooves on a surface thereof, each of the plurality of grooves extending in an extending direction between one of the adjacent two tubes and an other of the adjacent two tubes, at least two of the plurality of grooves in parallel with each other are merged at a merging portion, the merging portion is fluidly connected to one end of a hydrophilicity reducing portion in the extending direction, an other end of the hydrophilicity reducing portion in the extending direction is fluidly connected to a branching portion from which at least two of the plurality of grooves in parallel with each other branch off, and the hydrophilicity reducing portion is configured to reduce a hydrophilicity of a portion of the surface between the merging portion and the branching portion to less than that of a portion of the surface where the at least two of the plurality of grooves merged at the merging portion and the at least two of the plurality of grooves branching from the branching portion are formed.

9. The heat exchanger according to claim 8, wherein the hydrophilicity reducing portion is a plurality of hydrophilicity reducing portions.

10. The heat exchanger according to claim 8, wherein each of the plurality of fin body portions has a plurality of louvers each formed by cutting and bending a portion of each of the plurality of fin body portions, the hydrophilicity reducing portion is a plurality of hydrophilicity reducing portions, and the plurality of hydrophilicity reducing portions are diagonally arranged relative to a direction perpendicular to the extending direction from one of the adjacent two tubes toward the other.

* * * * *